United States Patent [19]

Tsay

[11] Patent Number: 4,505,136

[45] Date of Patent: Mar. 19, 1985

[54] DUST BLOWER FOR CIRCULAR KNITTING MACHINES

[76] Inventor: Jiann T. Tsay, No. 9, Ln. 27, Chung Hsin Rd., Sec. 1, Shi Tzu, Tapei Hsien, Taiwan

[21] Appl. No.: 447,669

[22] Filed: Dec. 7, 1982

[51] Int. Cl.[3] ..... D04B 35/32

[52] U.S. Cl. ..... 66/168

[58] Field of Search ..... 66/168

[56] References Cited

U.S. PATENT DOCUMENTS 4,312,195 1/1982 Nürk ..... 66/168

FOREIGN PATENT DOCUMENTS 1273557 9/1961 France ..... 66/168
65623 2/1969 German Democratic Rep. ... 66/168
34664 5/1970 German Democratic Rep. ... 66/168
248140 7/1969 U.S.S.R. ..... 66/168
367195 3/1973 U.S.S.R. ..... 66/168

OTHER PUBLICATIONS

Translation of U.S.S.R. Document No. 248,140.

*Primary Examiner*—Wm. Carter Reynolds
*Attorney, Agent, or Firm*—Tak K. Sung

[57] ABSTRACT

A dust blower for circular knitting machines, having a plurality of electric fans each one of which being mounted on an arm adjustably mounted around a rotatable frame which is driven by a driving device independent of the electric fans, the driving device being an electric motor or a rotating member of the circular knitting machine with which the dust blower is used.

1 Claim, 6 Drawing Figures

DUST BLOWER FOR CIRCULAR KNITTING MACHINES

BACKGROUND OF THE INVENTION

The present invention relates to a lint blower for circular knitting machines, more particularly to a lint blower having a plurality of electric fans each mounted on an arm adjustably mounted around a rotatable frame which is driven by a driving device independent from the electric fans.

Circular knitting machines produce lint when they are in operation. The lint may stick to various parts of the machine and may cause the machine to breakdown. Therefore, a lint blower is employed to blow the lint away from the circular knitting machine.

Generally, the lint blower for a circular knitting machines is installed within the machine to blow the lint from inside out. Because of the construction of circular knitting machines, lint blowers for circular knitting machines are designed to produce air streams that rotate around the center axis of the circular knitting machine so as to blow air against various parts of the machine.

One of the most commonly used lint blowers for circular knitting machines comprises a plurality of electric fans each adjustably mounted on an arm adjustably supported by a rotatable frame, wherein the electric fans are so mounted to produce air streams in a generally tangential direction with respect to the rotatable frame so that the rotatable frame is rotated by the reaction of the thrust of the air streams produced by the electric fans.

In such an arrangement as described above the rotating speed of the rotatable frame depends on the direction of each air stream which further depends on the setting of each electric fan. When the electric fans are set to produce air streams in the desired directions the rotating speed of the rotatable frame may not be adequate; and when the electric fans are set to attain an adequate rotating speed of the rotatable frame, the directions of the air streams produced by the electric fans may not be proper to blow away the lint as desired.

Therefore, it is the main object of this invention to provide a lint blower for circular knitting machines, the lint blower having a plurality of electric fans each adjustably mounted on an arm which is adjustably mounted onto a rotatable frame driven by a driving device to rotate independently.

DETAILED DESCRIPTION OF THE INVENTION

Figure 1:
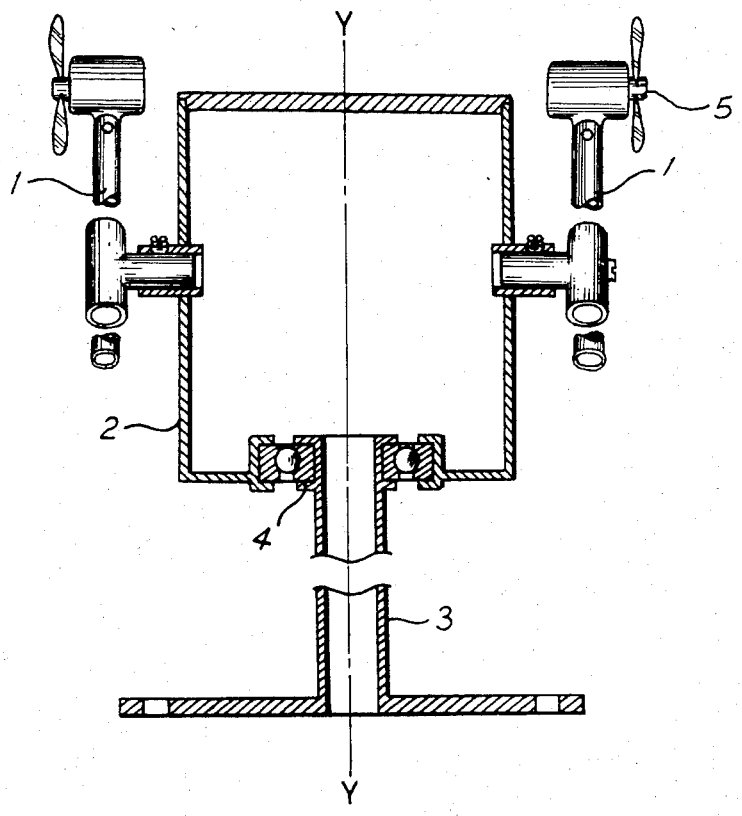
FIG. 1 PRIOR ART
FIG. 1 is a schematic, sectional view of the rotatable frame of a conventional lint blower for a circular knitting machine.

A known lint blower for a circular knitting machine, as shown in FIG. 1, comprises a rotatable frame 2 rotatably supported by a stand 3 with a bearing 4, a plurality of arms 1, and a plurality of fans 5 each of which being adjustably mounted at one end of arm 1 whose other end is adjustably mounted on the periphery of rotatable frame 2. Electrical power is supplied to each fan 5 so that fans 5 rotate and produce air streams, which are adapted to blow away the lint, and also to cause rotatable frame 2 to rotate around vertical axis Y—Y.

This invention offers an improved construction of a lint blower for circular knitting machines, having a rotatable frame driven independently of the fans.

Figure 2:
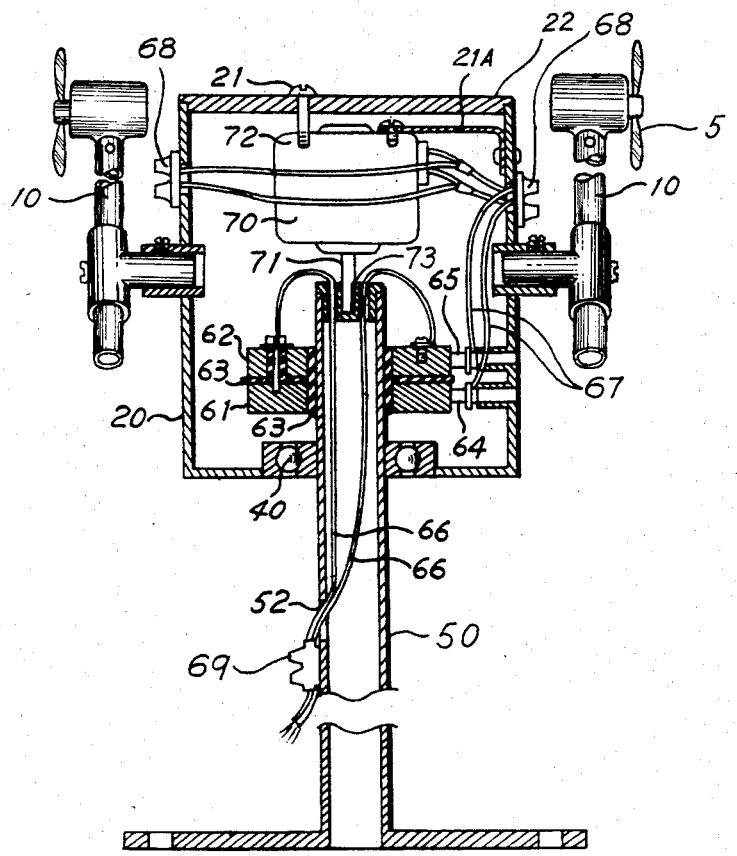
FIG. 2 is a cross sectional view of the rotatable frame of a first embodiment of the lint blower of this invention.
Figure 3:
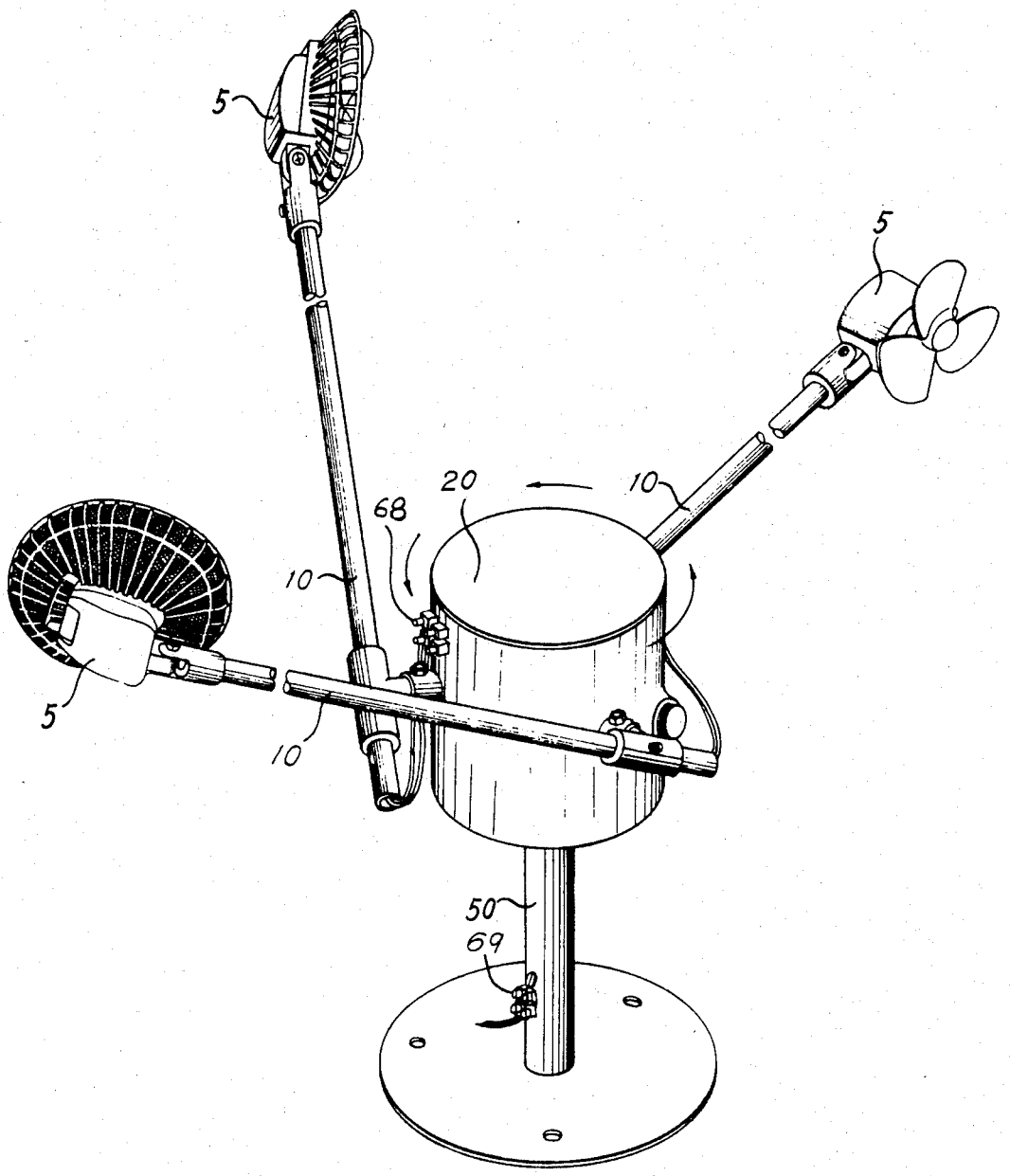
FIG. 3 is an oblique, perspective view of the first embodiment shown in FIG. 2.

In the first embodiment of this invention as shown in FIG. 2, the dust blower comprises a rotatable frame 20 rotatably supported by a stand 50 with a bearing 40, a plurality of electric fans 5 each one of which being adjustably mounted at one end of an arm 10 whose other end is adjustably mounted onto the periphery of rotatable frame 20, and an electric motor 70 having casing 72 fixedly mounted within rotatable frame 20, electric motor 70 having an output shaft 71 securely connected to an upper end of stand 50.

As shown in FIG. 2, electric motor 70 has a casing 72 which is fixedly mounted to an upper plate member 22 with capscrews 21, and is also secured to a side wall of rotatable frame 20 with bracket 21A. Output shaft 71 of electric motor 70 is inserted into the upper end of stand 50 with a key member 73 securely holding output shaft 71 with respect to stand 50. Electric power is supplied to electric motor 70 with a first pair of electric cords 66, 66, which are passed through the interior of stand 50 and are connected to a pair of electrically conductive ring members 61, 62 fixedly mounted in a coaxially arrangement with respect to stand 50; a pair of electrically conductive brush members 64, 65 respectively in resilient contact with ring members 61, 62, and a second pair of electric cords 67 connecting the pair of brush members 64, 65 with electric motor 70. A plurality of connections with switches 68 are provided in the second pair of electric cords 67 so that electric power may be supplied to each electric fan 5 through these switches 68. In the drawing, 69 is a switch connecting first pair of electric cords 66, 66 to a power source, not shown. Pair of ring members 61, 62 are electrically insulated from each other and from stand 50 by an insulating member 63.

When switches 68 and 69 are turned on to energize electric motor 70 and electric fans 5, electric motor casing 72 rotates with respect to output shaft 71 which is securely held onto the upper end of stand 50, causing rotatable frame 20 to rotate with respect to stand 50, and in the meantime electric fans 5 rotate to produce air streams. Since electric fans 5 are adjustably mounted onto rotatable frame 20 with arm 10, electric fans 5 also move along a circular path around stand 50, causing the air streams produced by electric fans 5 also to move along the same circular path accordingly. In this arrangement rotatable frame 20 rotates at a constant speed without being affected by the reactive thrust produced by the air streams; therefore electric fans 5 can be mounted in any manner to produce air streams in any direction as desired without affecting the rotation of rotatable frame 20.

Figure 4:
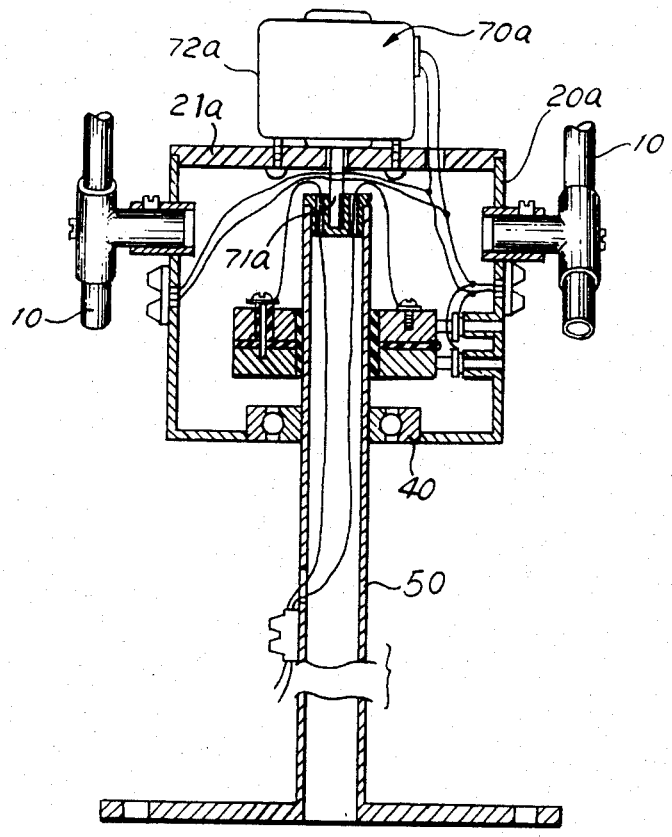
FIG. 4 is a cross sectional view of the rotatable frame of a second embodiment of the lint blower of this invention.

FIG. 4 shows a second embodiment of this invention. In this embodiment, electric motor 70*a* is mounted on the upper side of upper plate member 21*a* of rotatable frame 20*a*, electric motor 70*a* having output shaft 71*a* extending downwardly through upper plate member 21*a* and securely held in the upper end of stand 50. The arrangement of the remaining parts in the same as the first embodiment.

Figure 5:
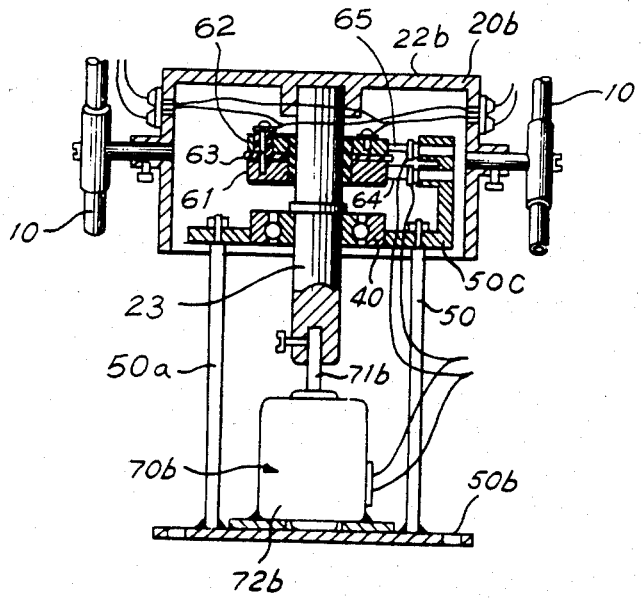
FIG. 5 is a cross sectional view of the rotatable frame of a third embodiment of the lint blower of this invention.

FIG. 5 shows a part of a third embodiment of this invention. In this embodiment the lint blower is provided with a rotatable frame 20*b* having a central shaft 23 rotatably supported by a stand 50 having an upper supporting plate 50C, a plurality of supporting posts 50*a* and a base 50*b*. Central shaft 23 has an upper end fixed to an upper plate 22*b* of rotatable frame 20*b* and a lower end extending downwardly, and is rotatably supported by a bearing 40 which is fixedly held by upper supporting plate 50C of stand 50. An electric motor 70*b* is mounted on a central part of base 50*b*, electric motor 70*b* having an output shaft 71*b* securely connected to the lower end of central shaft 23. Rotatable frame 20*b* is provided with a plurality of arms 10 each one of which having one end adjustably mounted onto the periphery of rotatable frame 20*b*, and the other end provided with an electric fan, not shown, adjustably mounted thereon as in the first embodiment.

Central shaft 23 is provided with a pair of electrically conductive ring members 61, 62, ring member 61, 62 being coaxially fixed to central shaft 23, having an insulating member 63 adapted to insulate ring member 61, 62 from each other and from central shaft 23. Upper supporting plate 50C is provided with a pair of electrically conductive brush members 64, 65 in resilient contact with ring member 61, 62 respectively; ring members 61, 62 being electrically connected to each electric fan, not shown; and brush members 64, 65 being electrically connected to a power source.

In the third embodiment as described above, rotatable frame 20*b* is driven by electric motor 70*b* to rotate independently of the electric fans adjustably mounted on arm 10.

Figure 6:
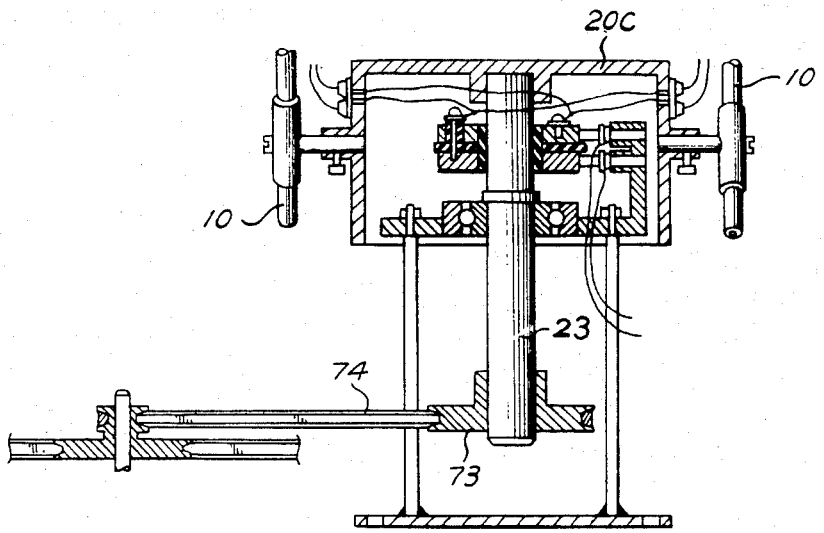
FIG. 6 is a cross sectional view of the rotatable frame of a fourth embodiment of the lint blower of this invention.

FIG. 6 shows a part of a fourth embodiment. In this arrangement, central shaft 23 as described with respect to the third embodiment is provided with a belt pulley 73 adapted to be driven by a belt 74 which may be driven by another belt pulley mounted onto a rotating member of the circular knitting machine, not shown, for which the lint blower is used.

It should now be apparent that according to this invention the rotating frame of a lint blower for a circular knitting machine is driven to rotate in a manner independent from the electric fans mounted onto the rotating frame for producing air streams and therefore, the erratic rotations that frequently associated with conventional lint blowers for circular knitting machines will not occur and the lint can be blown away effectively.

I claim:

1. A lint blower for circular knitting machines, comprising:

a stand member;

a rotatable frame rotatably mounted onto said stand member, said rotatable frame having an upper plate member;

a plurality of arms each one of which having a first end adjustably mounted onto the periphery of said rotatable frame and a second end extending away from said rotatable frame, said second end having an electric fan adjustably mounted thereon and being adapted to produce an air stream when energized to rotate; and an electric motor mounted above said upper plate member of said rotatable frame to cause said rotatable frame to rotate independently from the rotation of said electric fans, said electric motor having an output shaft securely connected to an upper end of said stand.

* * * * *